US008348872B2

(12) United States Patent
Lunter et al.

(10) Patent No.: US 8,348,872 B2
(45) Date of Patent: Jan. 8, 2013

(54) APPARATUS FOR DRY HYDRO-THERAPY BODY MASSAGE WITH FLUID SPRAY CONTROL DEVICE

(75) Inventors: Paul J. Lunter, Palm Harbor, FL (US); Timothy S. Elliott, Pinellas Park, FL (US)

(73) Assignee: JTL Enterprises Inc., Clearwater, FL (US)

( * ) Notice: Subject to any disclaimer, the term of this patent is extended or adjusted under 35 U.S.C. 154(b) by 1205 days.

(21) Appl. No.: 12/157,544

(22) Filed: Jun. 11, 2008

(65) Prior Publication Data

US 2009/0312680 A1 Dec. 17, 2009

(51) Int. Cl.
*A61H 7/00* (2006.01)

(52) U.S. Cl. ..... 601/148; 601/150

(58) Field of Classification Search ..... 601/148, 601/149, 150, 154, 155–159; 5/670, 918
See application file for complete search history.

(56) References Cited

U.S. PATENT DOCUMENTS

| | | | | |
|---|---|---|---|---|
| 3,595,223 | A | 7/1971 | Castagna | 128/33 |
| 3,636,944 | A | 1/1972 | Bryant | 128/24.1 |
| 3,747,916 | A | 7/1973 | Benson | 269/322 |
| 3,776,460 | A | 12/1973 | Fichter | 239/101 |
| 3,788,306 | A | 1/1974 | Eberhard | 128/66 |
| 3,880,154 | A | 4/1975 | Gabmeier | 128/66 |
| 3,886,936 | A | 6/1975 | Wehrenberg | 128/66 |
| 3,958,282 | A | 5/1976 | Crowe | 4/185 L |
| 3,994,030 | A | 11/1976 | Cassell et al. | 4/185 L |
| 4,090,507 | A | 5/1978 | Van Horn | 128/66 |
| 4,112,943 | A | 9/1978 | Adams | 128/24.1 |
| 4,139,001 | A | 2/1979 | Macabee | 128/64 |
| 4,221,008 | A | 9/1980 | Nolan | 4/496 |
| 4,258,706 | A | 3/1981 | Shank | 128/33 |
| 4,339,833 | A | 7/1982 | Mandell | 4/542 |
| 4,419,776 | A | 12/1983 | Schmidt | 4/564 |
| 4,541,418 | A | 9/1985 | Kirby | 128/24.1 |
| 4,607,405 | A | 8/1986 | Ellis et al. | 5/451 |
| 4,635,619 | A | 1/1987 | Diamond | 128/39 |
| 4,635,620 | A | 1/1987 | Ricchio | 128/64 |
| 4,651,720 | A | 3/1987 | Baus | 128/38 |
| D289,438 | S | 4/1987 | Lofgren | D24/38 |
| 4,712,788 | A | 12/1987 | Gaudreau, Jr. | 272/69 |
| 4,726,080 | A | 2/1988 | Henkin et al. | 4/542 |
| 4,727,605 | A | 3/1988 | Henkin et al. | 4/542 |

(Continued)

FOREIGN PATENT DOCUMENTS

| | | |
|---|---|---|
| CH | 161694 | 5/1933 |

(Continued)

OTHER PUBLICATIONS

Flotation Sleep Industry, Mar. 1985, p. 61, Advertisement Hammacher Schlemmer, Fall Supplement.

*Primary Examiner* — Michael A. Brown
(74) *Attorney, Agent, or Firm* — K&L Gates LLP

(57) ABSTRACT

In an apparatus for dry hydro-therapy body massage comprising a housing structure having a user support surface and a fluid spray arrangement interiorly within the housing structure for directing a fluid stream at the user support surface for imparting a massaging effect through the support surface to the body of a user thereon, a control device is disposed within the housing structure between the fluid spray arrangement and the user support surface for altering directional flow of the fluid stream relative to a selected portion of the user's body.

16 Claims, 5 Drawing Sheets

U.S. PATENT DOCUMENTS

| | | | | |
|---|---|---|---|---|
| 4,751,919 | A | 6/1988 | Thomsen | 128/66 |
| 4,757,562 | A | 7/1988 | Mützell | 4/615 |
| 4,757,808 | A | 7/1988 | Effler, Jr. | 128/66 |
| 4,761,838 | A | 8/1988 | Hargrove | 4/542 |
| 4,764,999 | A | 8/1988 | Rushing | 4/542 |
| 4,825,854 | A | 5/1989 | Henkin et al. | 128/66 |
| 4,839,930 | A | 6/1989 | Watkins | 4/546 |
| 4,853,988 | A | 8/1989 | Mützell | 4/615 |
| 4,908,016 | A | 3/1990 | Thomsen | 128/66 |
| 4,920,588 | A | 5/1990 | Watkins | 4/542 |
| 4,976,256 | A | 12/1990 | Marlin et al. | 128/64 |
| 5,074,286 | A | 12/1991 | Gillaspie et al. | 128/33 |
| 5,103,509 | A | 4/1992 | Richards | 4/564.1 |
| 5,295,929 | A | 3/1994 | Weisz | 462/54 |
| 5,386,599 | A | 2/1995 | Cartwright | 4/547 |
| 5,387,181 | A | 2/1995 | Olsen | 601/155 |
| 5,418,984 | A | 5/1995 | Livingston, Jr. | 4/541.1 |
| 5,487,713 | A | 1/1996 | Butler | 482/111 |
| 5,503,618 | A | 4/1996 | Rey | 601/15 |
| 5,514,078 | A | 5/1996 | Palmer | 601/149 |
| 5,540,651 | A | 7/1996 | Risch et al. | 601/148 |
| 5,548,852 | A | 8/1996 | Rowe | 4/509 |
| 5,704,079 | A | 1/1998 | Desnoyers | 4/541.6 |
| 5,713,834 | A | 2/1998 | Palmer | 601/149 |
| 5,827,206 | A | 10/1998 | Lunter | 601/148 |
| 5,903,934 | A | 5/1999 | Sears, III | 4/538 |
| 5,937,454 | A | 8/1999 | Drew | 4/565.1 |
| 5,951,447 | A | 9/1999 | Butler | 482/111 |
| 6,003,166 | A | 12/1999 | Hald et al. | 4/541.1 |
| 6,036,663 | A | 3/2000 | Arzt | 601/156 |
| 6,055,685 | A | 5/2000 | Norton et al. | 4/565.1 |
| 6,073,277 | A | 6/2000 | Banks | 4/541.5 |
| 6,178,570 | B1 | 1/2001 | Denst et al. | 4/541.6 |
| 6,210,351 | B1 | 4/2001 | Korenaga | 601/148 |
| 6,256,805 | B1 | 7/2001 | Ludlow et al. | 4/541.1 |
| 6,282,735 | B1 | 9/2001 | Stolpmann et al. | 5/606 |
| 6,306,108 | B1 | 10/2001 | Butler | 601/36 |
| 6,470,509 | B1 | 10/2002 | Ayeni | 4/541.6 |
| 6,546,570 | B1 | 4/2003 | Eidson | 4/546 |
| 6,572,570 | B1 | 6/2003 | Burns et al. | 601/148 |
| 6,770,043 | B1 | 8/2004 | Kahn | 601/160 |
| 6,872,219 | B2 | 3/2005 | Lofgren | 607/82 |

FOREIGN PATENT DOCUMENTS

| | | |
|---|---|---|
| DE | 2003137 | 7/1971 |
| DE | 2161678 | 6/1973 |
| JP | 404361753 | 12/1992 |
| JP | 406205811 | 7/1994 |

10
12
14
16
18
20
20A
20B
22
25
26
28
30
32
34
36
38
40
42
44
46
48
50
52
56
62
66
74
75
76
78
80
86
88
92
94
96
98
100
102
110
112
114
116
2
3
4

16
18
20
20A
20B
22
24
25
28
30
32
40
42
44
48
50
52
58
64
65
66
72
75
80
86
88
92
94
96
98
100
102
110
112
114
116

APPARATUS FOR DRY HYDRO-THERAPY BODY MASSAGE WITH FLUID SPRAY CONTROL DEVICE

BACKGROUND OF THE INVENTION

The present invention relates generally to apparatus for applying a massaging effect to the body of a user and, more particularly, to dry hydro-therapy body massage apparatus utilizing a fluid spray arrangement for massage effect.

Massage is a time-honored and generally effective therapy for muscular injuries, strains and general soreness but, although massage is still recommended by many physicians for such purposes, this therapy has severely limited availability due to a scarcity of trained, qualified masseurs. As a result, many devices and apparatus have been proposed in the past for producing a massage-like manipulation of a user's body by various means, ranging from mechanically or electrically-generated vibrations or pulsations, usually accompanied by heating, to pulsations of pressurized water, applied either is a wet environment such as partially submerging the user's body in a bath device or in a dry environment wherein a fluid spray arrangement is housed in a fluid-tight bed or chair type structure for applying a massaging effect to the user's body without requiring the user to disrobe.

Representative examples of the latter form of apparatus, often commonly referred to as dry hydro-therapy massage, are disclosed in U.S. Pat. Nos. 4,635,620; 4,751,919; 4,757,808; 4,908,016; 4,976,256; 5,074,286; 5,713,834; 5,827,206; and 6,036,663. Such apparatus have met with moderate success, and efforts continue within the relevant industry to expand their acceptance, availability and usefulness. As with virtually all mechanized appliances, optimal efficiency is desired. In many of known hydro-therapy massage apparatus, the massaging fluid spray is applied via a manifold device arranged for lengthwise travel within the interior of the apparatus alongside the body of a user. To adequately provide a massaging effect to the user's torso, the manifold is usually configured to generate a spray of a width generally commensurate with that of the typical shoulder, back, and hip areas of adult users. However, along the more narrow areas of the neck and legs of a user, the full width of the spray generated by the manifold is unnecessary and results in a portion of the hydro-massage spray impacting unoccupied areas of the user support surface, with a commensurate loss of efficiency and reduction massaging effect.

SUMMARY OF THE INVENTION

It is accordingly an object of the present invention to provide an improvement in dry hydro-therapy body massage apparatus which overcomes the above-described disadvantages of known apparatus and increases the efficiency and massaging effectiveness thereof.

Briefly summarized, the present invention is embodied in an apparatus for dry hydro-therapy body massage basically comprising a housing structure having a user support surface and a fluid spray arrangement interiorly within the housing structure for directing a fluid stream at the user support surface for imparting a massaging effect through the support surface to the body of a user thereon. In accordance with the basic concept of the present invention, a control device is provided within the housing structure between the fluid spray arrangement and the user support surface for altering directional flow of the fluid stream relative to a selected portion of the user's body.

The improvements of the present invention may be embodied in many different apparatus for dry hydro-therapy body massage. For example, the invention is readily adapted to apparatus wherein the user support surface is a generally horizontal bed surface on which the user may lay in a recumbent position. Alternatively, the invention is equally adapted for use in apparatus wherein the user support surface is a generally inclined seat surface on which the user may sit in an upright or partially reclining seated position.

The control device of the present invention may be disposed in any of various selected locations, or a combination of locations, in any such dry hydro-therapy body massage apparatus. The control device may be disposed in one or more fixed dispositions or in movable dispositions. The control device may be operative in an upper body region of the user support surface for limiting the fluid stream to flow against the neck of the user, or in a lower body region of the user support surface for limiting the fluid stream to flow against the legs of the user, or in both locations.

In basic operation, the control device is arranged to deflect, divert, or otherwise interrupt the directional flow of the fluid stream to selectively alter the impingement of the fluid stream against the user support surface. For example, the control device may comprise at least one deflector arranged to redirect the directional flow of the fluid stream.

In a dry hydro-therapy body massage apparatus wherein the fluid spray arrangement emits the fluid stream across a predominant width of the user support surface, the control device may be arranged to concentrate the fluid stream within a narrowed width of the user support surface in the area of the selected portion of the user's body, e.g., along the user's neck and/or legs. In apparatus wherein the fluid spray arrangement is movable for travel along the user support surface, the control device may be disposed in a stationary location between the fluid spray arrangement and the user support surface in the area of the selected portion of the user's body.

For example, in one preferred embodiment, the control device may comprise a pair of deflector plates disposed adjacent laterally outer margins of the user support surface in an upper body region of the user support surface for directing the fluid stream to flow against the neck of the user. In addition or alternatively, the control device may comprise a pair of deflector plates disposed in a generally central location of the user support surface in a lower body region of the user support surface for directing the fluid stream to flow against the legs of the user.

Alternatively, the control device may be mounted for travel with the fluid spray arrangement and for movement relative to the fluid spray arrangement. For example, the control device may be movable relative to the fluid spray arrangement between an operative position to interrupt and alter directional flow of the fluid stream and an inoperative position unimpeding directional flow of the fluid stream. In such embodiments, the control device may be movable dependent upon or otherwise according to the traveling position of the fluid spray arrangement.

In preferred embodiments, a liquid such as water is utilized as the massage fluid, and the housing structure has a liquid reservoir basin beneath the user support surface for containing a quantity of the massage liquid while the remaining interior area of the housing structure is mostly filled with air. The user support surface is preferably formed by a resiliently flexible membrane affixed to the housing in fluid-tight sealing relation. A weight-bearing open-mesh net may be disposed beneath the membrane for support of a user. A heater is preferably provided for heating the massage liquid.

The fluid spray arrangement may be of various configurations, for example, utilizing a plurality of spray or jet nozzles arranged in facing relation to the user support surface, and may include means for emitting the massage liquid in rapidly succeeding pulses.

DESCRIPTION OF THE PREFERRED EMBODIMENT

Figure 1:
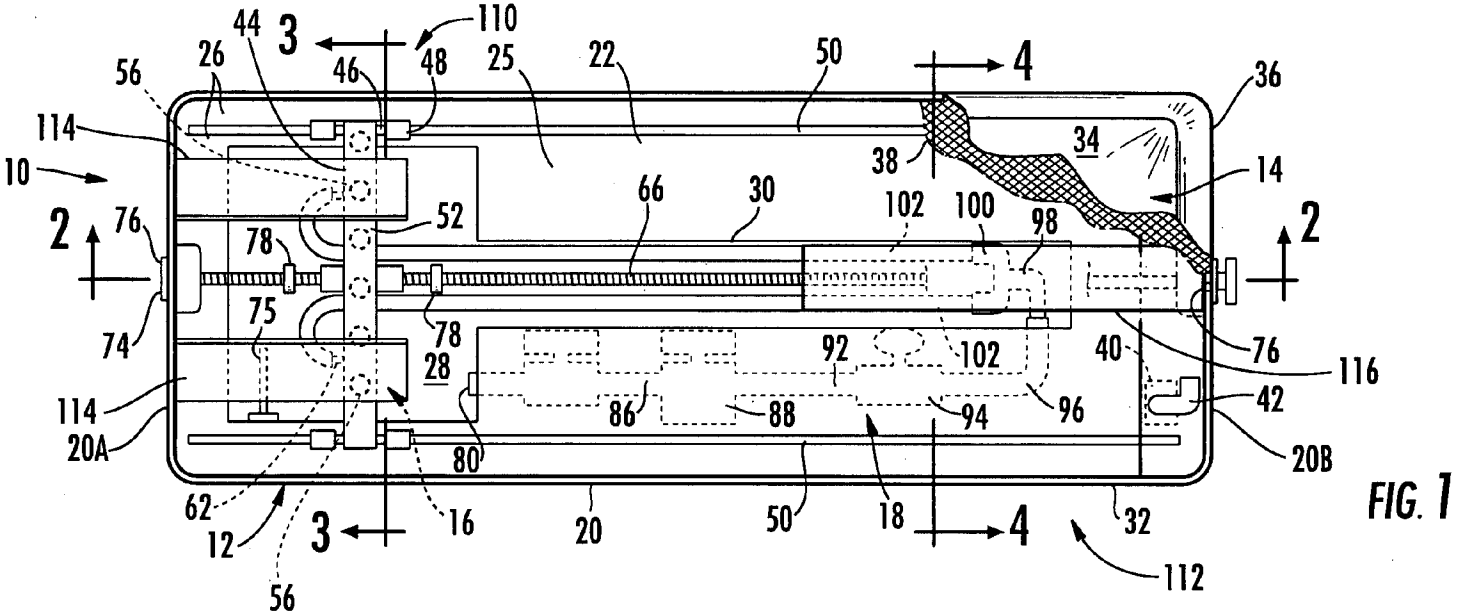
FIG. 1 is a top plan view of a representative form of dry hydro-therapy body massage apparatus of a bed-style wherein a user lies in a recumbent position during use and in which is incorporated a fluid spray control device in accordance with the present invention, the apparatus being partially broken away to show the fluid spray control device and other interior components of the apparatus.
Figure 2:
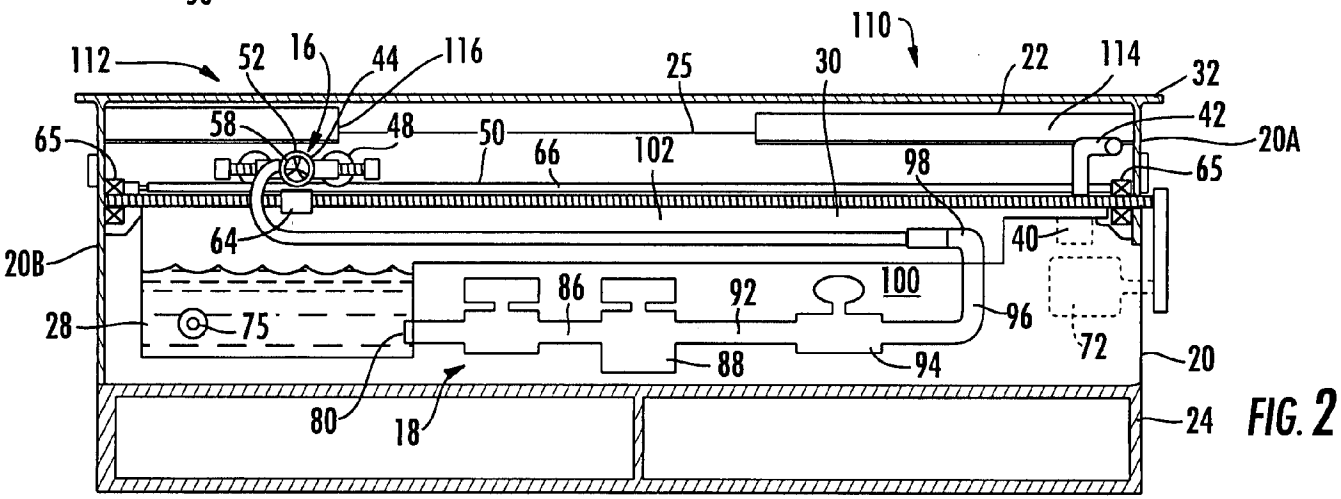
FIG. 2 is a vertical cross-sectional view of the dry hydro-therapy body massage apparatus of FIG. 1, taken along the line 2-2 thereof.
Figure 3:
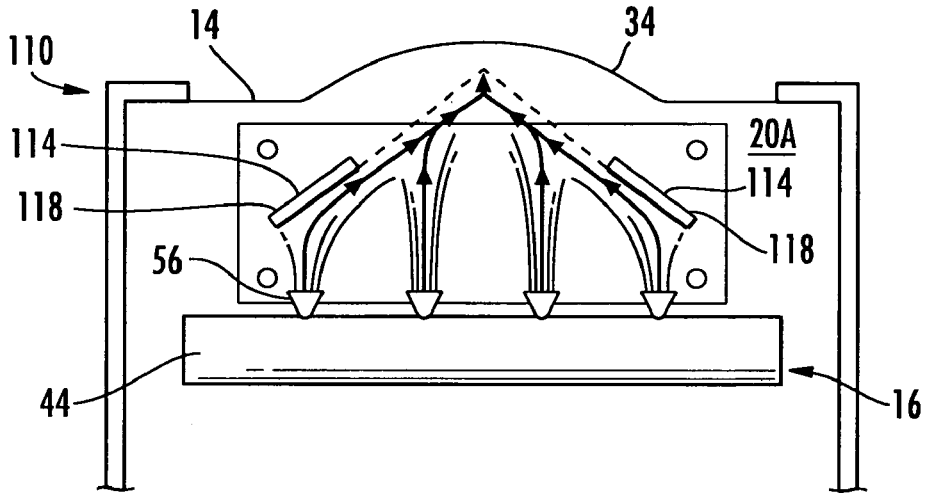
FIG. 3 is another vertical cross-sectional view of the dry hydro-therapy body massage apparatus of FIG. 1, taken along the line 3-3 thereof.
Figure 4:
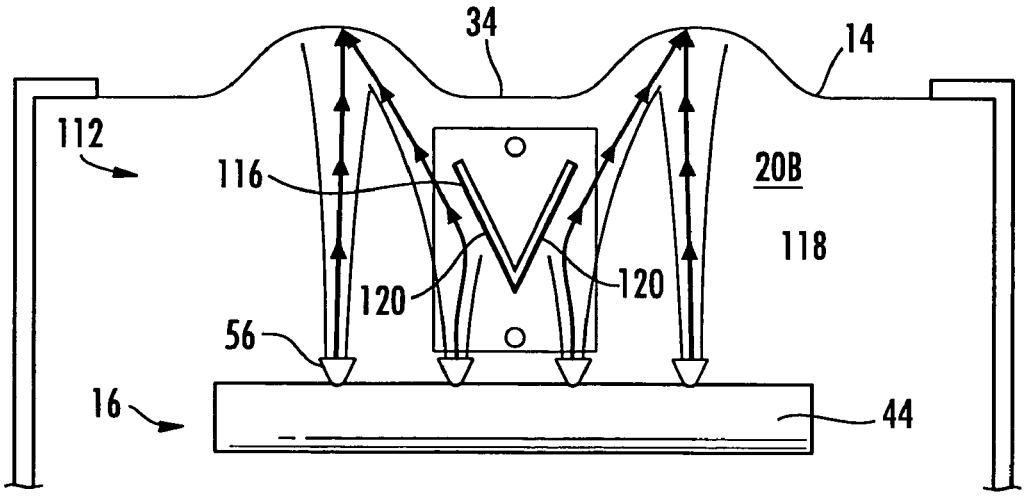
FIG. 4 is another vertical cross-sectional view of the dry hydro-therapy body massage apparatus of FIG. 1, taken along the line 4-4 thereof.

As will be readily understood by persons skilled in the relevant art, the fluid spray control device of the present invention is readily adapted to be embodied in many and various differing forms of dry hydro-therapy body massage apparatus. The present invention is described herein as embodied in two representative forms of such apparatus, but only for purposes of providing an exemplary enabling disclosure of the invention and, in particular, the invention is not intended to be limited, and should not be construed as limited, to application or embodiment in such apparatus nor any other particular structure or type of such apparatus except as defined in the claims appended hereto.

Referring now to the accompanying drawings and initially to FIGS. 1-4, a bed-style dry hydro-therapy body massage apparatus of a representative form known in the relevant industry is generally indicated at 10. The body massage apparatus 10 includes a housing structure, generally indicated at 12, generally in the form of a bed structure, presenting a generally horizontal upwardly facing side 14 forming a user support surface on which a user may lay in a recumbent position for massage treatment, as more fully explained hereinafter. A fluid spray arrangement, generally indicated at 16, is disposed within the housing in association with a pressurized fluid supply arrangement, generally indicated at 18, for directing a pressurized fluid emission at the underside of the user support surface 14 to transmit a massaging effect therethrough to the body of a user laying thereon.

The bed structure 12 includes a substantially hollow housing shell 20 generally in the form of a tank or tub of an overall rectangularly parallelipiped configuration closed at its bottom and side walls and substantially open at its top to define an upwardly-facing rectangular opening 22. The housing shell 20 may be fabricated of any suitable watertight, rigid material of appropriate strength which may be formed to the desired configuration herein described, e.g., fiberglass or a like material. The housing shell 20 may include a floor-standing frame 24, e.g., fabricated of metal tubing or the like, to elevate the user support surface 14 at a desired height above the floor while also providing an open area within the frame 24 and beneath the housing 20 for enclosure of various operating components of the body massage apparatus 10.

A hollow interior chamber 25 is defined by the housing shell 20. The housing shell 20 includes a generally horizontal shelf 26 which extends inwardly of the housing 20. The housing 20 further includes a reservoir basin 28 extending downwardly from the shelf 26 at one longitudinal end of the housing shell 20 and a more shallow drainage trough 30 extending lengthwise through the remainder of the interior chamber 25 of the housing shell 20 to open into the reservoir basin 28. A flange 32 projects outwardly from the uppermost extent of the housing shell 20 for mounting thereto of the user support surface 14.

A liquid material is preferred as the fluid medium utilized by the body massage apparatus 10 for supply to and emission from the fluid spray arrangement 16 to produce a massage effect as hereinafter described, water being an optimal liquid in view of its ready availability and generally non-corrosive and non-caustic character. A suitable supply of water, or another appropriate liquid, is stored in the liquid reservoir basin 28 for continuous circulation through the fluid supply arrangement 18 and the fluid spray arrangement 16, the shelf 26 and the drainage trough 30 as well as the other interior surfaces of the housing 20 being configured to drain the liquid emitted from the fluid spray arrangement 16 into the basin 28. Of course, as those persons skilled in the art will readily recognize, pressurized air, other gases, and other fluidic materials could also be utilized as the fluid massaging medium without departing from the scope and substance of the present invention and, accordingly, the present invention is not intended to be and should not be construed as limited to the use of water or another liquid massage medium.

It is also preferred that the water or other massage liquid be heated to enhance the massaging effect produced by the liquid, e.g., to a temperature approximating normal body temperature, preferably in the range of 95 to 100 degrees Fahrenheit, although the apparatus has the capability of a broad range of liquid temperatures. For this purpose, a heater element 75 may be mounted to a side wall of the housing shell 20 at a location within the liquid reservoir basin 28 below the normal level of massage liquid therein to be substantially continuously submerged in the stored massage liquid. A thermostat (not shown) is preferably provided in the electrical circuit to the heating element 75 to provide selective control of the temperature of the massage liquid. The apparatus may also be provided with a liquid cooling system if and to the extent necessary or desirable to offset heat gain to the massage liquid that may also occur from frictional contact of the liquid while being circulated through the apparatus.

The user support surface 14 may be formed of a relatively thin sheet 34 of a waterproof material affixed in watertight relation across the flange 32 bordering the upwardly facing opening 22 and covered by a cushioned rectangular frame 36 corresponding in dimension and affixed to the upper flange 32 of the housing shell 20. The sheet 34 preferably is sufficiently thin that the impact of fluid emitted from the fluid spray arrangement 16 against the underside of the sheet 34 transmits a massaging effect through the sheet 34 to the body of the user. Further, the sheet 34 is preferably of a sufficient flexibility and resiliency to substantially conform to the body of the user for maximum transmission of the massage effect through the sheet 34 to the user. In this manner, the sheet 34 functions in the nature of a waterproof membrane to keep the user dry during operation of the body massage apparatus 10 without noticeably dampening the massaging impact of fluid emitted from the fluid spray arrangement 16. For example, a latex rubber in sheet form, in the range of 40 to 55 mil. thickness, is a suitable material to provide these characteristics for the sheet 34, although various other commercially available rubber and plastic sheeting materials should also provide suitable results.

As a primary means of weight bearing support of the user, an open-mesh netting 38 may be affixed in tensioned condition to the flange 32 of the housing shell 20 horizontally across its opening 22 immediately beneath the sheet 34. The netting 38 should be of sufficient strength to independently support the weight of a user to provide a safety barrier in the event of a rupture or other failure of the sheet 34. At the same time, the open-mesh construction of the netting 38 permits essentially unrestricted transmission of fluid from the fluid spray arrangement 16 through the netting 38 and against the underside of the sheet 34.

Other than the portion of the interior chamber 25 occupied by the water stored in the basin 28 and the area occupied by the fluid spray arrangement 16 and the fluid supply arrangement 18, the interior chamber 25 of the housing shell 20 is substantially filled with air. A motor-operated fan 40 may be communicated with the interior of the chamber 25, e.g., through a tubular conduit 42, if desired to slightly pressurize the air within the chamber 25 during use of the massage apparatus 10 to slightly inflate the sheet 34 to enhance the feeling of support to a user laying on the sheet 34 and the netting 38 and at the same time to maximize conformity of the sheet 34 to the body of the user.

The fluid spray arrangement 16 includes an elongate massage head, generally indicated at 44, mounted for traversing travel back-and-forth through substantially the full lengthwise extent of the chamber 25 with the elongate extent of the head 44 oriented transversely across substantially the full widthwise extent of the chamber 25. For example, the massage head 44 may be provided at its opposite ends with carriage members 46 having wheels 48 supported on a pair of tracks 50 extending in parallel relation through substantially the full lengthwise extent of the chamber 25 on the respective longitudinally-extending, upwardly-facing surfaces of the shelf 26 to dispose the massage head 44 for lengthwise traversing travel within the chamber 25. The massage head 44 may be of any of various possible configurations and componentry adapted to emit the massage fluid under pressure against the underside of the membrane sheet 34. For example, in one possible configuration, the massage head 44 may have a substantially hollow outer body 52 with a plurality of emission openings each fitted with a venturi-type tubular jet nozzle 56 over substantially the full extent of the upward surface of the body 52 which faces the sheet 34 for causing pressurized fluid delivered into the body 52 to be emitted in a jet-like spray upwardly from the nozzles 56 against the underside of the membrane sheet 34.

Pressurized fluid is delivered from the fluid supply arrangement 18 to the massage head 44 in any suitable way. For example, the pressurized fluid supply arrangement 18 may have an electric motor 90 driving a liquid pump 88 to draw fluid from the liquid reservoir basin 28 of the housing shell 20, e.g., via a submerged tubular fitting 80. The outlet side of the pump 88 delivers the fluid under pressure to the massage head 44 through conduit 92, flow control valve 94, conduit 96, branch conduit 98, and two lengths of flexible tubing 102 connected between the branch conduit 98 and fittings 62 on opposite ends of the outer body 52 of the massage head 44.

The traversing travel of the massage head 44 is driven reciprocally back-and-forth through the lengthwise extent of the massage chamber 25 via any suitable drive mechanism, e.g., via a motor 72 belt-driving a drive screw 66 extending longitudinally through the massage chamber 25 and threaded to a drive bearing 64 affixed to the underside of the outer body 52 of the massage head 44, whereby driven rotation of the screw 66 in opposite rotational directions effects traveling movement of the massage head 44 lengthwise through the chamber 25 in respectively opposite directions. Any suitable form of sensors, such as electric eyes (not shown), may be provided at the limits of the massage head travel to control reversal of the drive motor 72.

The operation of the body massage apparatus of the present invention may thus be understood. As the massage head 44 travels back-and-forth lengthwise within the chamber 25, the pressurized liquid is delivered from the pump 88 through the intervening conduits into the interior of the outer body 52 of the massage head 44 and in jet-like spray therefrom through the emission nozzles 56. The relative thinness of the sheet 34 together with its resilient flexibility causes the sheet 34 to conform relatively closely to the shape and contours of the user's body and, in turn, the impact of the jetted liquid against the underside of the sheet 34 is readily transmitted therethrough to the body of the user to produce a massaging effect on the user's body. As the massage head 44 reaches each opposite end of the interior chamber 25 in its traveling movement, the electric eyes recognize the presence of the massage head 44 and, in turn, actuate reversal of the electric motor 72 to initiate driving of the massage head 44 in the opposite direction. In this manner, the massage head 44 travels back-and-forth the full length of the interior chamber 25 to apply a massaging effect over the user's entire body.

As will be understood, the widthwise reach of the massage head 44 laterally across the interior chamber 25 effectively applies a massaging action to the full lateral extent of the body of a user supported on the user support surface 14, and in particular across the full width of the user's shoulders, back or chest, mid-section and hips. In the distal head region 110 and leg region 112 of the user support surface 14, by contrast, the fluid spray is not needed across the full widthwise reach of the massage head 44 to accomplish an effective massaging action of the more narrow neck and legs of the user. Therefore, to insure an optimum application of the massaging spray to these selected areas of the user's body, the present invention provides a control arrangement, preferably in the form of deflectors 114, 116, arranged in the interior chamber 25 intermediate the fluid spray arrangement 16 and the underside of the user support surface 14 to selectively alter and redirect the directional flow of the fluid spray to be concentrated in a more narrow widthwise portion of the user support surface 14 at predominantly only the user's neck and legs.

More specifically, the deflector 114 comprises a pair of deflector plates 118 affixed within the interior chamber 25 to the end wall 20A of the housing shell 20 at a lateral spacing from one another and extending therefrom in essentially horizontal disposition longitudinally of the housing along the underside of laterally outer margins of head region 110 of the user support surface 14 and above the fluid spray arrangement 16. The deflector plates 118 are thereby respectively disposed outwardly alongside the area of the user support surface 14 on which a user's neck and head will rest and the plates 118 are inclined toward one another in converging relationship for deflecting inwardly toward the underside of the user support surface 14 in the spacing between the plates 118 the portions of the fluid stream from the outermost ends of the massage head 44 which would otherwise impact unoccupied areas of the user support surface 14, to thereby redirect the deflected portions of the fluid spray to impact against the neck of the user.

Similarly, the deflector 116 comprises a pair of deflector plates 120 affixed within the interior chamber 25 to the opposite end wall 20B of the housing shell 20 immediately adjacent one another and extending therefrom in essentially horizontal disposition longitudinally of the housing centrally along the underside of the leg region 112 of the user support surface 14 and above the fluid spray arrangement 16. The deflector plates 120 are thereby respectively disposed alongside the central longitudinal area of the user support surface 14 between the outward areas on which a user's legs will rest. The plates 120 abut one another along common lower plate edges and are inclined upwardly away one another in diverging relationship for deflecting outwardly toward the underside of the user support surface 14 outwardly of the plates 120 the portions of the fluid stream from the central extent of the massage head 44 which would otherwise impact the unoccupied area of the user support surface 14 between the user's legs, to thereby redirect the deflected portions of the fluid spray to impact against the legs of the user.

As will this be understood, the present body massage apparatus 10 provides several distinct advantages. Most fundamentally, the control device of the present invention largely insures that substantially the entirety of the fluid stream sprayed from across the entire width of the massage head 44 impacts the user's body and, in particular, in the areas of the user support surface occupied by narrow parts of the body such as the neck and legs, the control device redirects and concentrates the fluid stream against the user's neck and legs. In this manner, the fluid spray is efficiently utilized without any of the spray wasted by impacting against unoccupied areas of the user support surface. The control device further insures that the fluid spray in such areas of the user support surface is concentrated against the user's neck and legs to insure optimal massaging effect against these body parts.

Figure 5:
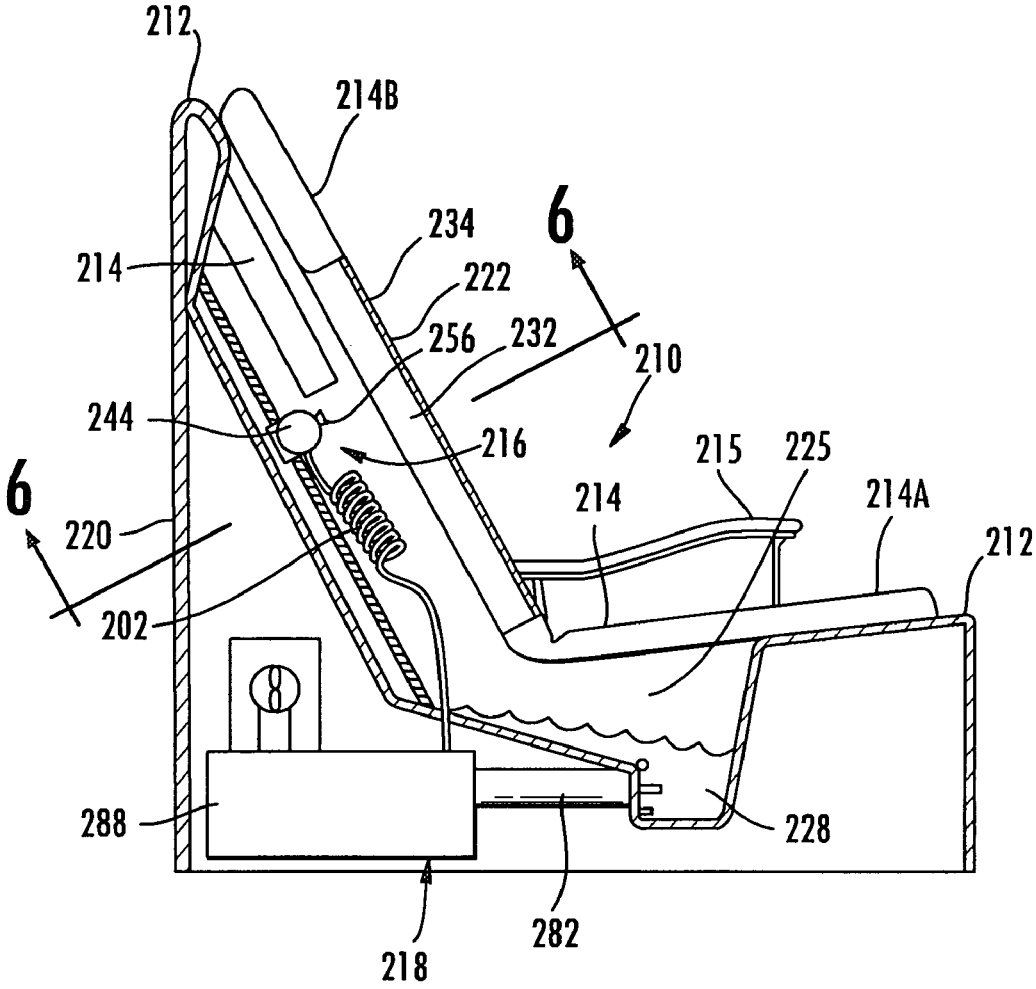
FIG. 5 is a side elevational view of another representative form of dry hydro-therapy body massage apparatus of a lounge chair-style wherein a user sits in a seated position during use and in which is incorporated a fluid spray control device in accordance with the present invention, the apparatus being partially broken away to show the fluid spray control device and other interior components of the apparatus.
Figure 6:
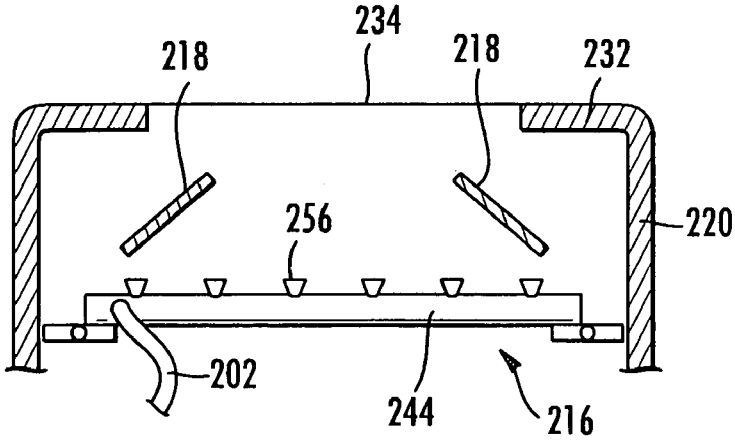
FIG. 6 is a cross-sectional view of the dry hydro-therapy body massage apparatus of FIG. 5, taken along the line 6-6 thereof.

As previously stated, the present invention has applicability to various types of hydro-therapy body massage apparatus, and in particular, to other apparatus than the bed-style apparatus of FIGS. 1-4. By way of example but without limitation, an alternative embodiment of the present invention in a chair or lounge-style massage apparatus is depicted schematically in FIGS. 5 and 6 and indicated generally at 210. The chair-style massage apparatus 210 basically includes a housing structure 212 including a substantially hollow floor-standing housing shell 220 which is formed generally as a chair presenting an angular user support surface 214 including a seat surface 214A and a seat back surface 214B, and with arm rests 215 disposed on either side of the user support surface 214.

The housing shell 220 is formed with a forwardly-facing rectangular opening 222 at the forward side of the seat back surface 214B bordered by a flange portion 232 of the housing shell 220 forming the outer margins of the seat back surface 214B. The rectangular opening 222 is covered by sheet-like flexible resilient membrane 234 of a waterproof material affixed in watertight relation across the flange 232 bordering the opening 222. Within the interior chamber 225 of the housing shell 220, the massage apparatus 210 includes a fluid spray arrangement 216 including an elongate massage head 244 oriented transversely across the seat back surface 214B and mounted for traversing travel back-and-forth along the lengthwise extent of the seat back surface 214B. The massage head 244 may be equipped with a plurality of jet nozzles 256 arranged across the lateral extent of the massage head 244, or any of various other possible configurations and componentry. A suitable supply of water, or another appropriate massage liquid, is stored in a liquid reservoir basin 228 formed in the housing shell 220 for continuous circulation to the massage head 244 through a fluid supply arrangement 218 which basically comprises an intake conduit 282 communicating between the reservoir basin 228 and a liquid pump 288, and a flexible tubing 202 communicating between the pump 288 and the massage head 244. The interior of the housing shell 220 is configured to drain massage liquid sprayed by the massage head 244 to return to the reservoir basin 228.

In operation, a user assumes a seated position on the apparatus 210 and the pump 288 is activated, drawing water from the reservoir basin 228 and delivering the water under pressure through the pump 50 into the massage head 244 to be emitted from the nozzles 256 against the membrane 234 as it travels along the seat back surface 214B to massage the back of a user.

As in the bed-style massage apparatus 10 of the embodiment of FIGS. 1-4, the full lateral widthwise reach of the massage head 244 across the interior chamber 225 effectively applies a massaging action across the full width of the user's shoulders and back but the full widthwise reach of the massage head 244 is not needed to accomplish an effective massaging action of the more narrow neck area of the user. Therefore, the present invention provides a control arrangement in the form of a deflector 214 similar to that of the embodiment of FIGS. 1-4, disposed within the interior chamber 225 adjacent the upper extent of the seat back surface 214B intermediate the underside thereof and the fluid spray arrangement 216 to selectively alter and redirect the directional flow of the fluid spray to be concentrated in a more narrow widthwise portion of the seat back surface 214B at predominantly only the user's neck.

More specifically, the deflector 214 comprises a pair of deflector plates 218 affixed to the housing shell 220 within an upper head region of the seat back surface 214B within the interior chamber 225 at a lateral spacing from one another and extending along the underside of laterally outer margins of the seat back surface 214B in generally parallel relation thereto forwardly of the fluid spray arrangement 216. The deflector plates 218 are thereby respectively disposed outwardly alongside the area of the seat back surface 214B on which a user's neck and head will rest and the plates 218 are inclined toward one another in converging relationship for deflecting inwardly toward the underside of the seat back surface 214B in the spacing between the plates 218 the portions of the fluid stream from the outermost ends of the massage head 244 which would otherwise impact unoccupied areas of the user support surface 214, to thereby redirect the deflected portions of the fluid spray to impact against the neck of the user. As will be understood, this deflector arrangement thereby provides all of the same advantages as discussed above with respect to the embodiment of this invention in the bed-style massage apparatus of FIGS. 1-4.

While in each of the embodiments of the control device in FIGS. 1-4 and FIGS. 5 and 6 the control arrangement of the present invention is mounted in a fixed disposition for passive interruption and deflection of the fluid stream from the fluid spray arrangement, it is also contemplated, as previously indicated, that the control device may be mounted for traveling movement with the fluid spray arrangement along the length of the body massage apparatus as well as for movement relative to the fluid spray arrangement to provide for active movement of the control arrangement into and out of operative dispositions for deflecting the fluid stream. A representative form of one such arrangement is depicted in FIGS. 7 and 8A, 8B and 8C, and is adapted to be incorporated into either a bed style or a chair or lounge style apparatus such as that of FIGS. 1-4 or FIGS. 5 and 6.

Figure 7:
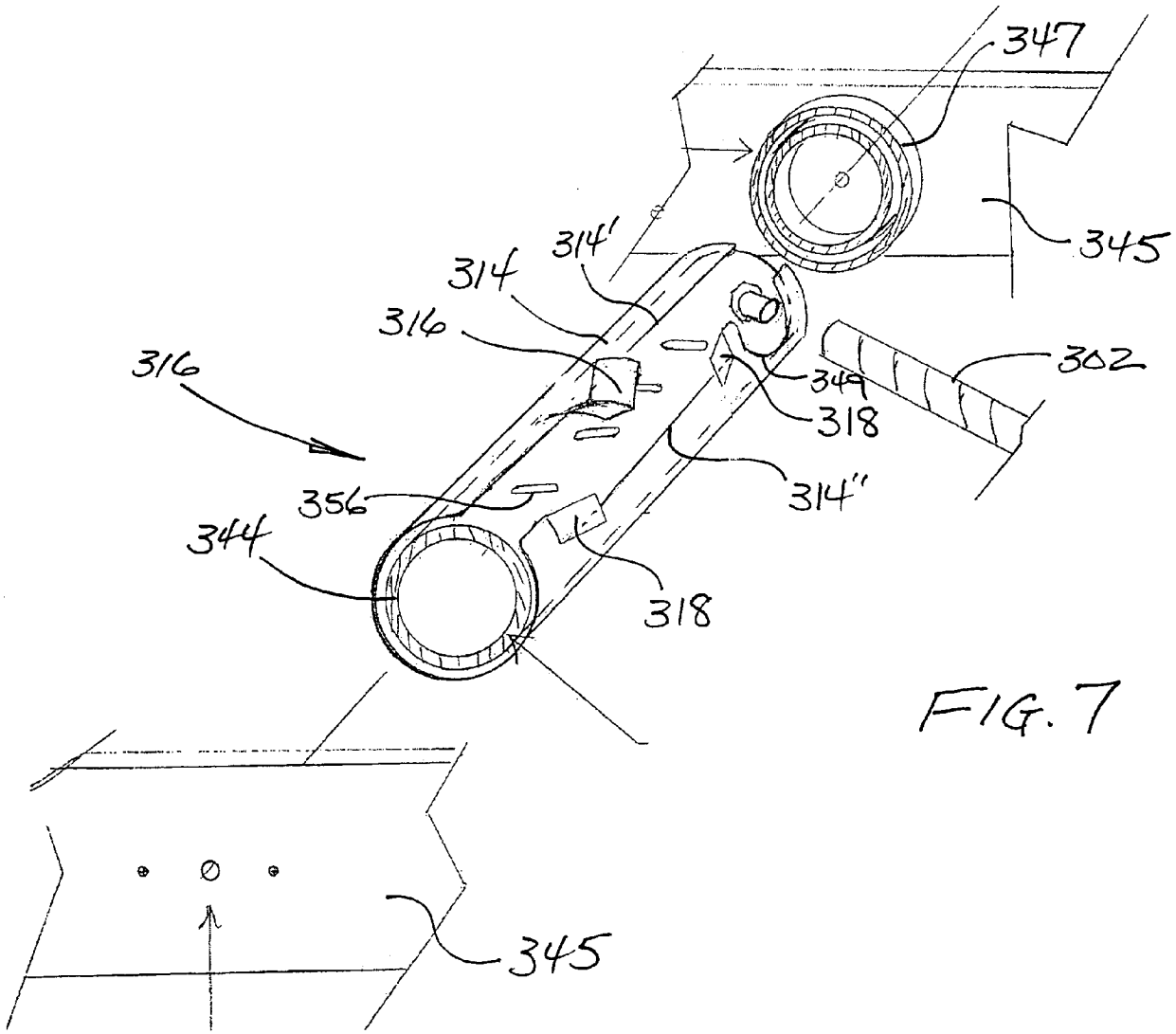
FIG. 7 is an exploded perspective view of an alternative embodiment of fluid spray control device according to the present invention, mounted for traveling movement with the fluid spray arrangement as well as for movement relative thereto.

As shown in FIG. 7, the massage head 344 of the fluid spray arrangement 316 is mounted between end brackets 345 by which the massage head 344 is moved lengthwise within the interior chamber of a body massage apparatus (not shown), e.g. via tracks or drive screws as in the embodiments of FIGS. 1-4 and FIGS. 5 and 6. A diverter sleeve 314 is mounted about the massage head 344 and is held for rotational movement relative thereto by bushings 347 fixed to the end brackets 345 to encircle and contain the mounted ends of the diverter sleeve 314. The diverter sleeve 314 encloses the massage head 344 about approximately 270 degrees of its circumference presenting facing edges 314', 314" spaced apart by an angular dimension slightly greater than that of the jet nozzles 356 of the massage head 344. The diverter sleeve 314 has a V-shaped deflector element 316 projecting from a central location along one edge 314' and a pair of angled deflector elements 318 projecting from spaced apart locations along the other edge 314". A cutout 349 may be provided in one end of the diverter sleeve 314 for attachment to the massage head 344 of a fluid supply tube 302.

Figure 8C:
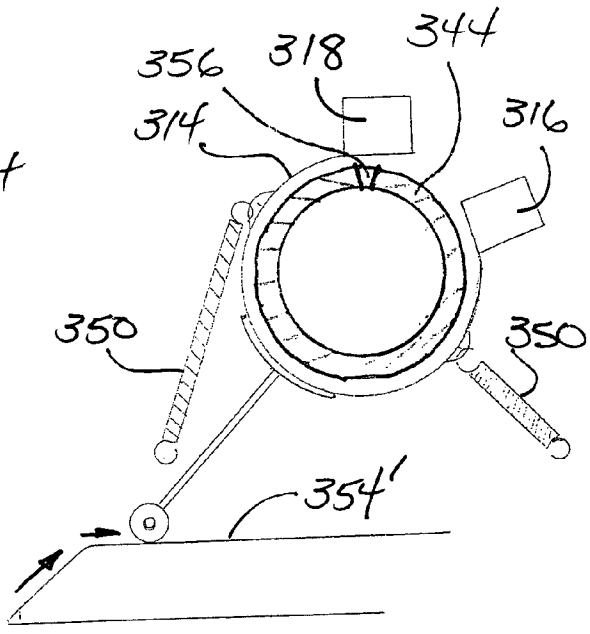
FIGS. 8A, 8B and 8C are a cross sectional views of the fluid spray control device and the fluid spray arrangement of FIG. 7, taken along line 8-8 thereof, depicting the fluid spray control device in differing operating dispositions according to the traveling movement of the fluid spray arrangement.
Figure 8B:
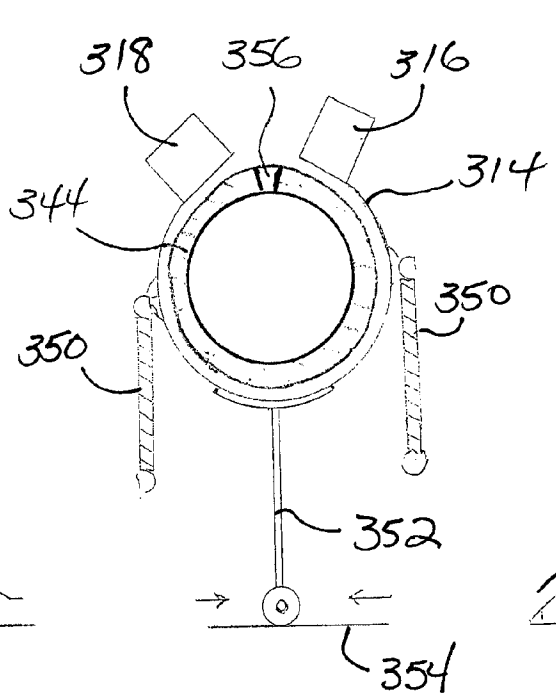
Figure 8A:
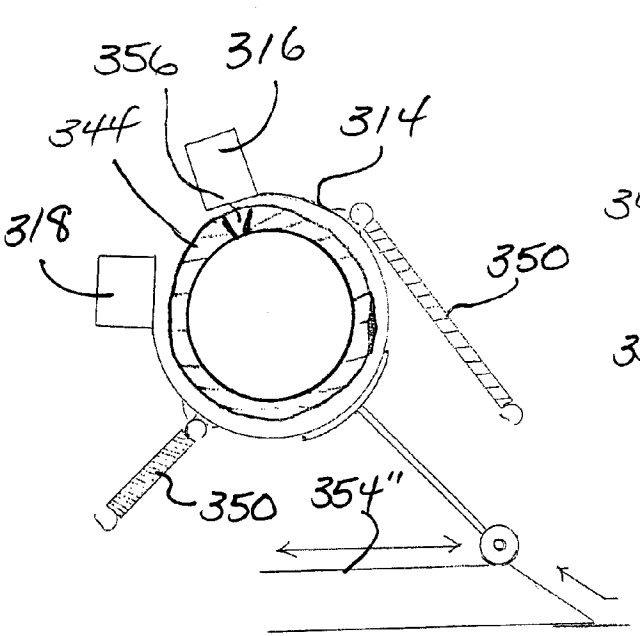

Opposing coil springs 350 FIGS. 8A, 8B, 8C) are connected between the diverter sleeve 314 and the end brackets 345 to bias the diverter sleeve 314 into a normal equilibrium position shown in FIG. 7 with the edges 314', 314" disposed at opposite sides of the jet nozzles 356, whereby the nozzles are exposed and uncovered for normal spray operation against the underside of the user support surface (not shown in FIG. 7) for the majority of the lengthwise travel of the massage head 344. A cam follower arm 352 is affixed to the underside of the diverter sleeve 314 and depends therefrom into following engagement with a cam track 354 extending lengthwise within the housing shell of the apparatus, as shown in FIG. 8.

As shown in FIG. 8C, at the head region (also not shown in FIG. 7 or 8A, 8B, 8C) of the user support surface, the cam track 354 has an elevated cam block 354' disposed to act on the cam follower arm 352 to rotate the diverter sleeve 114 in one rotational direction to cause sufficient rotation thereof to move the diverter elements 318 into a position overlying the laterally outermost jet nozzles 356 to deflect their fluid stream centrally relative to the user support surface to concentrate the collective fluid stream emission of the massage head 344 to impact against the neck of the user. As shown in FIG. 8A, at the lower leg region of the user support surface (also not shown in FIG. 7 or 8A, 8B, 8C), the cam track 354 has an elevated cam block 354" disposed to act on the cam follower arm 352 to rotate the diverter sleeve 114 in the opposite rotational direction to cause sufficient rotation thereof to move the diverter element 316 into a position overlying the centralmost jet nozzles 356 to deflect their fluid stream outwardly relative to the user support surface to concentrate the collective fluid stream emission of the massage head 344 to impact against the legs of the user. Intermediate the two cam blocks 354', 354" the cam track 354 maintains the cam follower arm 352 and, in turn, the diverter sleeve 314 in a rotational position relative to the massage head 344 so as not to cover or interfere with the fluid stream emission of the jet nozzles 356, thereby allowing the fluid stream to impact across the full widthwise extent of the user support surface, as depicted in FIG. 8B. In this manner, the movable diverter sleeve embodiment of FIGS. 7 and 8A, 8B, and 8C accomplishes substantially the same function and effect as the fixed diverter plates of FIGS. 1-4 and FIGS. 5 and 6.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In an apparatus for dry hydro-therapy body massage comprising a housing structure having a user support surface and a fluid spray arrangement interiorly within the housing structure for directing a fluid stream at the user support surface for imparting a massaging effect through the support surface to the body of a user thereon, the improvement comprising a control device within the housing structure between the fluid spray arrangement and the user support surface for interrupting the directional flow of the fluid stream relative to a selected portion of the user's body to selectively alter the impingement of the fluid stream against the user support surface.

2. The improvement in an apparatus for dry hydro-therapy body massage according to claim 1, wherein the user support surface is a generally horizontal bed surface on which the user may lay in a recumbent position.

3. The improvement in an apparatus for dry hydro-therapy body massage according to claim 1, wherein the user support surface is a generally inclined seat surface on which the user may sit in a seated position.

4. The improvement in an apparatus for dry hydro-therapy body massage according to claim 1, wherein the control device is operative in a head region of the user support surface for limiting the fluid stream to flow against the neck of the user.

5. The improvement in an apparatus for dry hydro-therapy body massage according to claim 1, wherein the control device is operative in a leg region of the user support surface for limiting the fluid stream to flow against the legs of the user.

6. The improvement in an apparatus for dry hydro-therapy body massage according to claim 1, wherein the control device is arranged to selectively redirect the directional flow of the fluid stream.

7. The improvement in an apparatus for dry hydro-therapy body massage according to claim 1, wherein the control device comprises at least one deflector arranged to divert the directional flow of the fluid stream.

8. The improvement in an apparatus for dry hydro-therapy body massage according to claim 1, wherein the fluid spray arrangement emits the fluid stream across a predominant width of the user support surface, and wherein the control device is arranged to concentrate the fluid stream within a narrowed width of the user support surface in the area of the selected portion of the user's body.

9. The improvement in an apparatus for dry hydro-therapy body massage according to claim 1, wherein the fluid spray arrangement is movable for travel along the user support surface, and wherein the control device is disposed in a stationary location between the fluid spray arrangement and the user support surface in the area of the selected portion of the user's body.

10. The improvement in an apparatus for dry hydro-therapy body massage according to claim 1, wherein the control device comprises a pair of deflector plates disposed adjacent laterally outer margins of the user support surface in an upper body region of the user support surface for directing the fluid stream to flow against the neck of the user.

11. The improvement in an apparatus for dry hydro-therapy body massage according to claim 1, wherein the control device comprises a pair of deflector plates disposed in a generally central location of the user support surface in an lower body region of the user support surface for directing the fluid stream to flow against the legs of the user.

12. The improvement in an apparatus for dry hydro-therapy body massage according to claim 1, wherein the fluid spray arrangement is movable for travel along the user support surface, and wherein the control device is mounted for travel with the fluid spray arrangement and for movement relative to the fluid spray arrangement between an operative position to interrupt and alter directional flow of the fluid stream and an inoperative position unimpeding directional flow of the fluid stream.

13. The improvement in an apparatus for dry hydro-therapy body massage according to claim 12, wherein the control device is movable according to the traveling position of the fluid spray arrangement.

14. In an apparatus for dry hydro-therapy body massage comprising a housing structure having a user support surface and a fluid spray arrangement movable interiorly within the housing structure for travel along the user support surface and adapted to emit a fluid stream directed at the user support surface across a predominant width thereof for imparting a massaging effect through the support surface along the body of a user thereon, the improvement comprising a diverter arrangement within the housing structure between the fluid spray arrangement and the user support surface for controlling directional flow of the fluid stream to a selected portion of the user's body, the diverter arrangement comprising a first diverter device including a pair of deflector plates disposed adjacent laterally outer margins of the user support surface in an upper body region of the user support surface for redirecting and concentrating the fluid stream within a narrowed width of the user support surface to flow against the neck of the user, and a second diverter device including a pair of deflector plates disposed in a generally central location of the user support surface in a lower body region of the user support surface for redirecting and concentrating the fluid stream within separately narrowed widths of the user support surface to flow against the legs of the user.

15. The improvement in an apparatus for dry hydro-therapy body massage according to claim 14, wherein the user support surface is a generally horizontal bed surface on which the user may lay in a recumbent position.

16. The improvement in an apparatus for dry hydro-therapy body massage according to claim 14, wherein the user support surface is a generally inclined seat surface on which the user may sit in a seated position.

* * * * *